US006713964B2

(12) United States Patent
Kim et al.

(10) Patent No.: US 6,713,964 B2
(45) Date of Patent: Mar. 30, 2004

(54) ELECTRON GUN FOR CATHODE RAY TUBE

(75) Inventors: Yoo-Seon Kim, Suwon (KR); Wan-Jae Son, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/358,309

(22) Filed: Feb. 5, 2003

(65) Prior Publication Data

US 2003/0222585 A1 Dec. 4, 2003

(30) Foreign Application Priority Data

May 30, 2002 (KR) ..... 2002/30328

(51) Int. Cl.[7] ..... G09G 3/015; H01J 29/50

(52) U.S. Cl. ..... 315/15; 313/412

(58) Field of Search ..... 315/15, 16, 17, 315/5.37, 5.38, 5.39, 5.41, 5.42; 313/412, 413, 414, 417, 479

(56) References Cited

U.S. PATENT DOCUMENTS 4,142,128 A * 2/1979 Odenthal ..... 315/15
4,271,374 A 6/1981 Kimura ..... 313/449
6,121,724 A * 9/2000 Hasegawa et al. ..... 313/479
6,476,544 B1 * 11/2002 Ishii et al. ..... 313/417

* cited by examiner

*Primary Examiner*—Don Wong
*Assistant Examiner*—Minh D A
(74) *Attorney, Agent, or Firm*—Robert E. Bushnell, Esq.

(57) ABSTRACT

The present invention provides an electron gun for a cathode ray tube that forms a main focus lens of a maximum diameter within a neck of a limited diameter to thereby realize high focus performance and resolution characteristics. The electron gun includes a single cathode emitting electrons; first and second grid electrodes forming a triode portion with the cathode; a third grid electrode provided subsequent to the second grid electrode; a fourth grid electrode provided subsequent to the third grid electrode and to which a focus voltage is applied, the fourth grid electrode including an input section positioned opposing the third grid electrode and an output section connected to the input section; a fifth grid electrode mounted surrounding part of the fourth grid electrode with a predetermined gap therebetween and to which an anode voltage is applied; and a connector interconnecting the third grid electrode and the fifth grid electrode, wherein the output section of the fourth grid electrode is exposed.

40 Claims, 8 Drawing Sheets

ELECTRON GUN FOR CATHODE RAY TUBE

CLAIM OF PRIORITY

This application makes reference to, incorporates the same herein, and claims all benefits accruing under 35 U.S.C. §119 from my application ELECTRON GUN FOR CATHODE RAY TUBE filed with the Korean Industrial Property Office on May 30, 2002 and there duly assigned Ser. No. 30328/2002.

BACKGROUND OF THE INVENTION

1. Technical Field

The present invention relates to an electron gun for a cathode ray tube, and more particularly, to an electron gun for a cathode ray tube in which an efficiency of a main focus lens is maximized within a limited neck diameter such that high focus performance and resolution characteristics are obtained.

2. Related Art

A projection system that utilizes cathode ray tubes (CRTs) to realize large screen images typically includes as the main elements three monochrome cathode ray tubes, each for realizing an image of a single color, that is, a green image, a blue image, or a red image; and an optical lens system for enlarging and projecting each of the single color images onto a projection screen to combine the images as a full color image.

In the monochrome cathode ray tube, since the screen is scanned using a single electron beam, the focus performance of the electron beam directly affects the resolution of the display device. Further, because the image of each monochrome cathode ray tube is enlarged by approximately ten times before being projected onto the screen, it is necessary to increase screen brightness by emitting an electron beam of a high current density from each of the electron guns.

Accordingly, the electron gun provided in the monochrome cathode ray tube uses a unipotential focus or a hi-unipotential focus connecting structure that provides for high focus performance in a high current region, in addition to using an electrode structure that optimizes the performance of a main focus lens.

In the unipotential focus or hi-unipotential focus methods, the main focus lens of the electron gun is formed between focus and anode electrodes by a difference between a focus voltage applied to the focus electrode and an anode voltage applied to the anode electrode. The main focus lens focuses an electron beam emitted from a cathode to form an electron beam spot on a phosphor screen.

The performance of the main focus lens is affected by equivalent diameter and spherical aberration. Spherical aberration decreases with increases in the equivalent diameter of the main focus lens, and a spot size of an electron beam landing on the phosphor screen increases with increases in spherical aberration.

Therefore, there may be an effort to optimize a triode portion to limit the spherical aberration of the main focus lens, or to enlarge the diameter of the main focus lens to increase the efficiency of the same. In particular, to increase the diameter of the main focus lens, it is necessary to physically enlarge the focus electrode and the anode electrode.

However, efforts to physically increase the diameter of the focus and anode electrodes are constrained by the standardized diameter of the neck in present commercial use. As a result, there is a need for an electron gun structure that forms the main focus lens to a maximum diameter within the limited diameter of the neck.

SUMMARY OF THE INVENTION

The present invention provides an electron gun for a cathode ray tube, in which an electrode structure is improved to maximize an equivalent diameter of a main focus lens within a neck of a limited diameter such that exceptional focus performance and resolution characteristics are realized.

The present invention provides an electron gun for a cathode ray tube including a single cathode emitting electrons; first and second grid electrodes forming a triode portion with the cathode; a third grid electrode provided subsequent to the second grid electrode; a fourth grid electrode provided subsequent to the third grid electrode and to which a focus voltage is applied, the fourth grid electrode including an input section positioned opposing the third grid electrode and an output section connected to the input section; a fifth grid electrode mounted surrounding part of the fourth grid electrode with a predetermined gap therebetween and to which an anode voltage is applied; and a connector electrically interconnecting the third grid electrode and the fifth grid electrode. The fifth grid electrode is positioned surrounding the fourth grid electrode in such a manner to expose the output section of the fourth grid electrode.

Preferably, the fourth grid electrode is cylindrical, and a diameter of the output section Is greater than a diameter of the input section; and the fifth grid electrode is also cylindrical and includes an input section and an output section, the output section having a diameter that is larger than a diameter of the input section.

The fourth grid electrode and the fifth grid electrode satisfy the following condition, $$1.08<D_2/D_1<2.0 \quad (1)$$

where $D_1$ is an outer diameter of the input section of the fourth grid electrode and $D_2$ is an outer diameter of the input section of the fifth grid electrode, and it is assumed that a thickness of the fifth grid electrode does not exceed 500 micrometers ($\mu$m).

The fourth grid electrode and the fifth grid electrode satisfy the following condition, $$1.0<D_4/D_3<1.2 \quad (2)$$

where $D_3$ is an outer diameter of the output section of the fourth grid electrode and $D_4$ is an outer diameter of the output section of the fifth grid electrode, and it is assumed the thickness of the fifth grid electrode does not exceed 500 micrometers ($\mu$m).

The fourth grid electrode is preferably divided into at least two sub-electrodes mounted with a gap therebetween.

An angled section is formed between the input and output sections of the fourth grid electrode, the angled section being progressively enlarged in diameter starting from an end connected to the input section of the fourth grid electrode and in a direction toward an end connected to the output section of the fourth grid electrode.

As another option, the output section of the fourth grid electrode may be formed such that an end connected to the input section of the fourth grid electrode is substantially identical in diameter to the input section, then is progressively enlarged from this end connected to the input section in a direction away from the cathode.

In accordance with the principles of the present invention, as embodied and broadly described, the present invention provides an electron gun for a cathode ray tube, the electron gun comprising: a cathode emitting electrons; first and second grid electrodes forming a triode portion with said cathode; a third grid electrode; a fourth grid electrode receiving a focus voltage, said third grid electrode being disposed between said cathode and said fourth grid electrode, said fourth grid electrode including an input section and an output section, the input section being disposed between the output section and said third grid electrode; a fifth grid electrode encircling a portion of said fourth grid electrode, at least a part of the output section of said fourth grid electrode being not encircled by said fifth grid electrode, said fifth grid electrode being spaced apart from said fourth grid electrode by a predetermined gap, said fifth grid electrode receiving an anode voltage; and a connector electrically connecting said third and fifth grid electrodes.

In accordance with the principles of the present invention, as embodied and broadly described, the present invention provides an electron gun for a cathode ray tube, the electron gun comprising: a single cathode emitting electrons; first and second grid electrodes forming a triode portion with said cathode; a third grid electrode; a fourth grid electrode receiving a focus voltage, said third grid electrode being disposed between said cathode and said fourth grid electrode, said fourth grid electrode including an input section and an output section, the input section being disposed between the output section and said third grid electrode, the output section of said fourth grid electrode having an edge facing away from said cathode; a fifth grid electrode receiving an anode voltage, said fifth grid electrode encircling a portion of said fourth grid electrode, at least a part of the output section of said fourth grid electrode being not encircled by said fifth grid electrode, said fifth grid electrode being spaced apart from said fourth grid electrode by a predetermined gap, said fifth grid electrode including an input section and an output section, the output section of said fifth grid electrode having an edge facing away from said cathode; and a connector electrically connecting said third and fifth grid electrodes, the edge of said fourth grid electrode being a first distance from said cathode, the edge of said fifth grid electrode being a second distance from said cathode, the first distance being larger than the second distance.

In accordance with the principles of the present invention, as embodied and broadly described, the present invention provides an electron gun for a cathode ray tube, the electron gun comprising: a cathode emitting electrons; a first electrode having an input section and an output section, an input end of the input section of said first electrode separating said cathode from an output end of the output section of said first electrode, said first electrode having a focus voltage applied; and a second electrode having an input section and an output section, an input end of the input section of said second electrode separating said cathode from an output end of the output section of said second electrode, said second electrode having an anode voltage applied, a distance between said cathode and the output end of the output section of said first electrode being greater than a distance between said cathode and the output end of the output section of said second electrode, said second electrode encircling a portion of said first electrode, at least a part of the output section of said first electrode being not encircled by said second electrode, said second electrode being spaced apart from said first electrode by a predetermined gap.

In accordance with the principles of the present invention, as embodied and broadly described, the present invention provides a method of operating an electron gun for a cathode ray tube, the method comprising: emitting electrons from a cathode; applying a focus voltage to a first electrode of the electron gun, the first electrode having an input section and an output section, an input end of the input section of the first electrode separating the cathode from an output end of the output section of the first electrode; and applying an anode voltage to a second electrode of the electron gun, the second electrode having an input section and an output section, an input end of the input section of the second electrode separating the cathode from an output end of the output section of the second electrode, a distance between the cathode and the output end of the output section of the first electrode being greater than a distance between the cathode and the output end of the output section of the second electrode, said second electrode encircling a portion of said first electrode, at least a part of the output section of said first electrode being not encircled by said second electrode, said second electrode being spaced apart from said first electrode by a predetermined gap.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DESCRIPTION OF BEST MODE OF CARRYING OUT THE INVENTION

While the present invention will be described more fully hereinafter with reference to the accompanying drawings, in which details of the present invention are shown, it is to be understood at the outset of the description which follows that persons of skill in the appropriate arts may modify the invention here described while still achieving the favorable results of this invention. Accordingly, the description of the best mode contemplated of carrying out the invention, which follows, is to be understood as being a broad, teaching disclosure directed to persons of skill in the appropriate arts, and not as limiting upon the present invention.

Illustrative embodiments of the best mode of carrying out the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure. Additionally, the embodiments disclosed can be combined to form differently shaped components of the electron gun consistent with the principles of the present invention.

Figure 11:
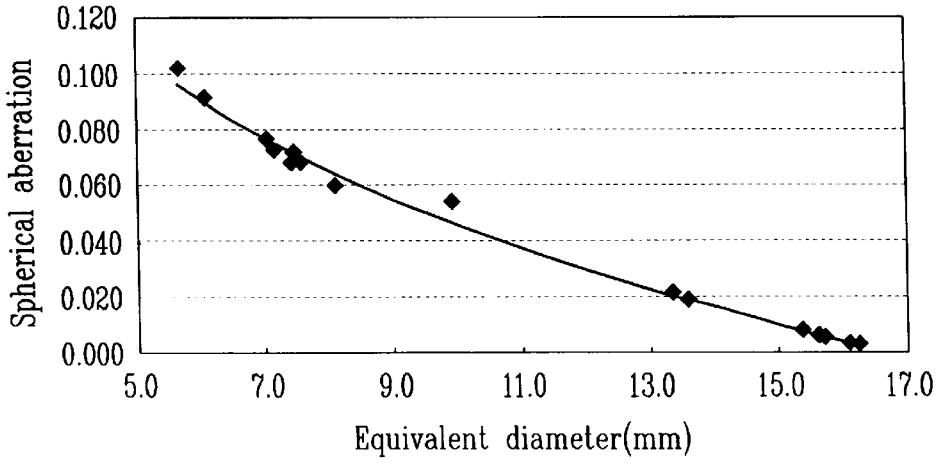
FIG. 11 is a graph showing the relation between equivalent diameter and spherical aberration.
Figure 12:
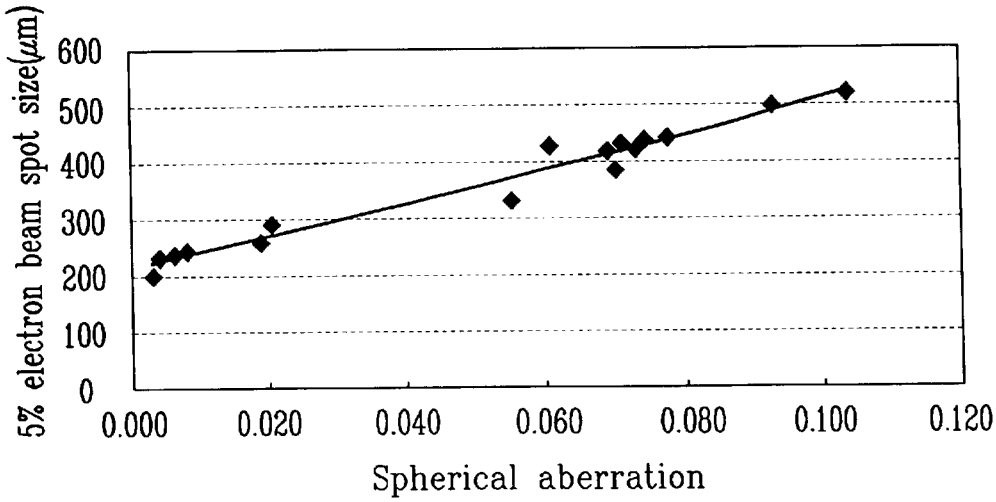
FIG. 12 is a graph showing the relation between spherical aberration and electron beam spot size.

The performance of the main focus lens is affected by equivalent diameter and spherical aberration. FIG. 11 is a graph showing the relation between equivalent diameter and spherical aberration, and FIG. 12 is a graph showing the relation between spherical aberration and electron beam spot size. As is evident from the graphs, spherical aberration decreases with increases in the equivalent diameter of the main focus lens, and a spot size of an electron beam landing on the phosphor screen increases with increases in spherical aberration. An example of an effort related to an electron gun for a cathode ray tube is U.S. Pat. No. 4,271,374 entitled ELECTRON GUN FOR CATHODE-RAY TUBE, issued to Kimura on Jun. 2, 1981.

Figure 1:
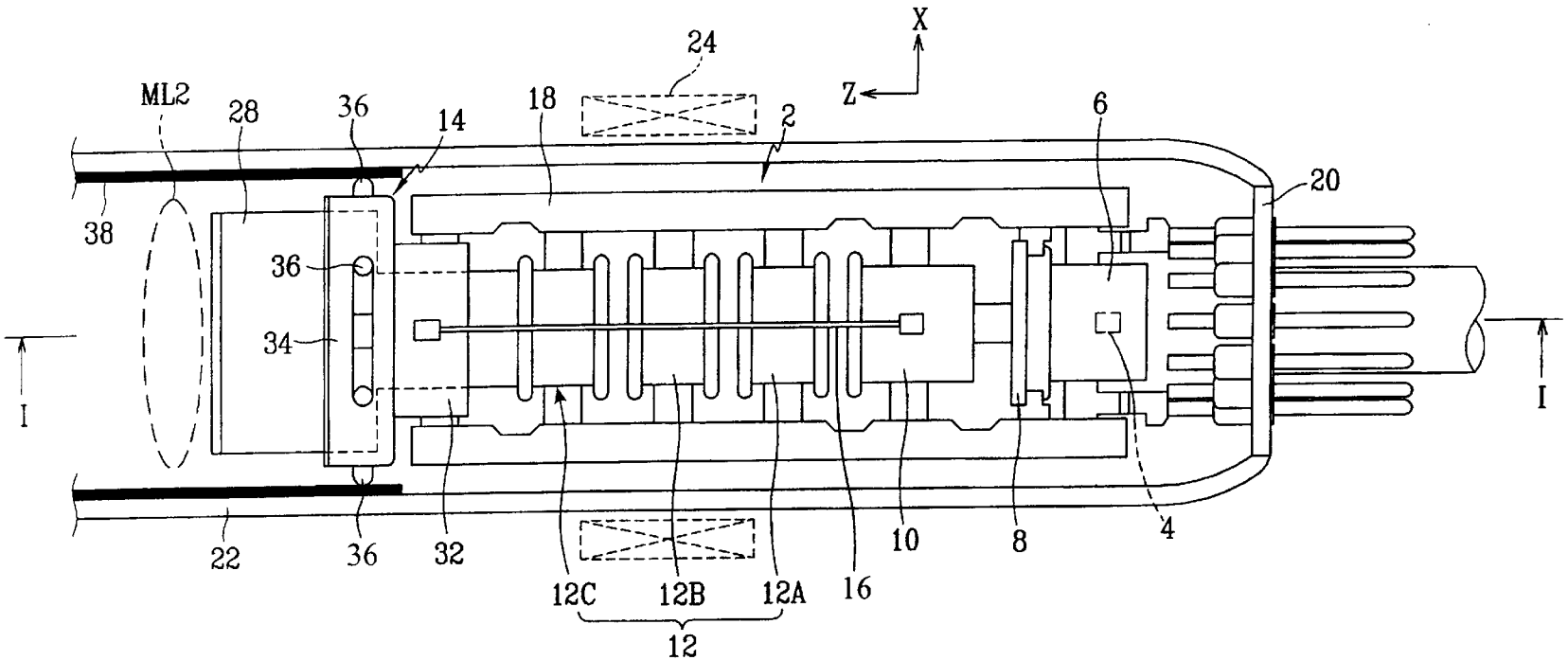
FIG. 1 is a perspective view of an electron gun for a cathode ray tube according to a preferred embodiment of the present invention, in accordance with the principles of the present invention.
Figure 2:
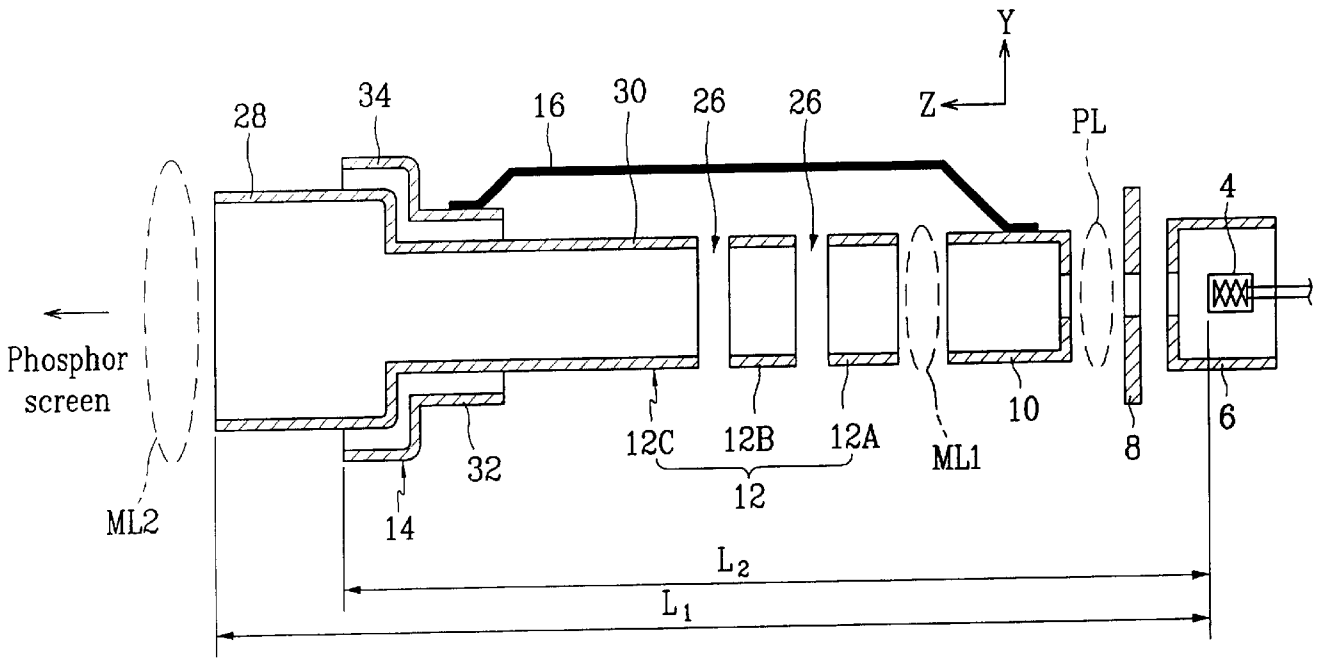
FIG. 2 is a sectional view taken along line I—I of FIG. 1, in accordance with the principles of the present invention.

The best mode of carrying out the invention will now be described in detail with reference to the accompanying drawings. FIG. 1 is a perspective view of an electron gun for a cathode ray tube according to a preferred embodiment of the present invention, in accordance with the principles of the present invention. FIG. 2 is a sectional view taken along line I—I of FIG. 1, in accordance with the principles of the present invention.

With reference to the drawings, the electron gun 2 includes a single cathode 4 for emitting electrons; first and second grid electrodes 6 and 8 forming a triode portion with the cathode 4, the first and second grid electrodes 6 and 8 controlling the emission of electrons; a third grid electrode 10 being provided adjacent to the second grid electrode 8; a fourth grid electrode 12 being provided adjacent to the third grid electrode 10 and to which a focus voltage is applied; a fifth grid electrode 14 mounted surrounding a part of the fourth grid electrode 12 with a predetermined gap therebetween and to which an anode voltage is applied; and a connector 16 for electrically connecting the third grid electrode 10 to the fifth grid electrode 14. The focus voltage and anode voltage are applied to the fourth grid electrode 12 and fifth grid electrode 14, respectively. That is, the fourth grid electrode 12 receives the focus voltage, and the fifth grid electrode 14 receives the anode voltage.

The above electrodes are fixedly supported by a bead glass 18 in a sequentially aligned manner starting from the cathode 4 and along an axis Z direction (in the drawings). A stem base 20 is fused to an end of a neck 22 such that the electron gun 2 is positioned within the neck 22 with a predetermined gap between the electron gun 2 and an inner surface of the neck 22.

The anode voltage, which is approximately 30~32 kilovolts (kV), is applied to both the third grid electrode 10 and the fifth grid electrode 14 through the connector 16. As a result, a pre-focus lens PL is formed between the second and third grid electrodes 8 and 10 by a difference in potential therebetween, and a first main focus lens ML1 is formed between the third and fourth grid electrodes 10 and 12 by a difference in potential therebetween.

In addition, the fourth grid electrode 12 is supplied the focus voltage, which is approximately 7~10 kilovolts (kV), through a corresponding stem pin (not shown). If a velocity modulator 24 is mounted to an outer circumference of the neck 22, the fourth grid electrode 12 may be separated into a plurality of sub-electrodes, for example, first, second and third sub-electrodes 12A, 12B, and 12C, with a predetermined gap 26 therebetween.

The velocity modulator 24 typically generates a bipolar magnetic field to control a deflection speed. In the case where the fourth grid electrode 12 generates eddy currents by a high frequency current formed by the velocity modulator 24, a sensitivity of the velocity modulator 24 deteriorates. Therefore, the generation of eddy currents is restrained through the gaps 26.

The first sub-electrode 12A and the second sub-electrode 12B of the fourth grid electrode 12 are interconnected by a connector (not shown), and the second sub-electrode 12B and the third sub-electrode 12C of the fourth grid electrode 12 are interconnected by a connector (not shown). Accordingly, the same focus voltage is applied to all the sub-electrodes 12A, 12B, and 12C of the fourth grid electrode 12.

Preferably, sub-electrodes 12A, 12B, and 12C forming the fourth grid electrode 12 are cylindrical and hollow to function also as electron beam passageways. The third sub-electrode 12C, which is the farthest from the cathode 4, has the largest diameter of the three sub-electrodes 12A, 12B, and 12C. That is, the third sub-electrode 12C is cylindrical and includes an input section 30 that is identical in diameter to the second sub-electrode 12B, and an output section 28 having a diameter larger than the diameter of the input section 30.

The fifth grid electrode 14 is also cylindrical and has a diameter larger than that of the fourth grid electrode 12. The fifth grid electrode 14 is formed surrounding part of the fourth grid electrode 12. Preferably, the fifth grid electrode 14 includes an input section 32, which is fixed by the bead glass 18, and an output section 34, which has a diameter larger than a diameter of the input section 32.

Two or more bulb spacers 36 are fixed to an outer circumference of the output section 34 of the fifth grid electrode 14. The bulb spacers 36 contact an inner graphite layer 38 deposited on the inner surface of the neck 22 to transmit an anode voltage applied to the graphite layer 38 to the fifth grid electrode 14. The bulb spacers 36 also maintain a predetermined gap between the fifth grid electrode 14 and the inner surface of the neck 22 to improve alignment characteristics of the electron gun 2.

In the electron gun 2 of FIG. 1, an end of the output section 28 of the third sub-electrode 12C, which has the largest diameter out of the three sub-electrodes 12A, 12B, and 12C of the fourth electrode 12, is not surrounded by the fifth electrode 14 and instead is exposed. Accordingly, a distance of length $L_1$ from the cathode 4 to the end of the output section 28 of the fourth grid electrode 12 is greater than a distance of length $L_2$ between the cathode 4 and an end of the output section 34 of the fifth grid electrode 14.

With part of the output section 28 of the fourth grid electrode 12 left exposed and not covered by the fifth grid electrode 14, the difference in voltage of the fourth grid electrode 12 and the graphite layer 38 results in the formation of a second main focus lens ML2 of a large diameter within the neck 22 and adjacent to the output section 28 of the fourth grid electrode 12 in a direction toward a phosphor screen.

The fifth grid electrode 14 encircles a portion of the fourth grid electrode 12. At least a part of the output section 28 of the fourth grid electrode 12 is not encircled by the fifth grid electrode 14, as shown in FIG. 2.

The fifth grid electrode 14 is at least partly cylindrical in shape, and the fourth grid electrode 12 is at least partly cylindrical in shape. The output section 34 of the fifth grid electrode 14 has a larger diameter than the output section 28 of the fourth grid electrode 12. The output section 34 of the fifth grid electrode 14 encircles or surrounds a portion of the fourth grid electrode 12, as shown in FIG. 2.

The fifth grid electrode 14 encircles a portion of the third sub-electrode 12C of the fourth grid electrode 12. At least a part of the output section 28 of the third sub-electrode 12C of the fourth grid electrode 12 is not encircled by the fifth grid electrode 14, as shown in FIG. 2.

As shown in FIG. 2, a part of the output section 28 of the third sub-electrode 12C of the fourth grid electrode 12 extends beyond the output section 34 of the fifth grid electrode 14, and thus that part of the output section 28 of the third sub-electrode 12C of the fourth grid electrode 12 is not encircled by the fifth grid electrode 14. Also, a part of the input section 30 of the third sub-electrode 12C of the fourth grid electrode 12 is not encircled by the fifth grid electrode 14, as shown in FIG. 2.

A connector 16 electrically connects the third grid electrode 10 to the fifth grid electrode 14, as shown in FIGS. 1 and 2. The fifth grid electrode 14 can have a thickness that does not exceed 500 micrometers. That is, the fifth grid electrode 14 can have a thickness that is equal to or less than 500 micrometers. In other words, the thickness of the fifth grid electrode 14 can be a thickness selected from among a first thickness that is 500 micrometers and a second thickness that is less than 500 micrometers.

The output section 28 of the third sub-electrode 12C of the fourth grid electrode 12 having an edge (or an end) that is facing away from the cathode, and that edge (or end) is a distance $L_1$ from the cathode as shown in FIG. 2. The output section 34 of the fifth grid electrode 14 having an edge (or end) facing away from the cathode, and that edge (or end) is a distance $L_2$ from the cathode as shown in FIG. 2. The distance $L_1$ is larger than the distance $L_2$, as shown in FIG. 2. The aforementioned edge of the output section 28 is a distance $(L_1-L_2)$ away from the aforementioned edge of the output section 34, as shown in FIG. 2.

It can be said that the third sub-electrode 12C of the fourth grid electrode 12 has an input section 30 and an output section 28, as shown in FIG. 2. Also, it can be said that the fourth grid electrode 12 has an input section 30 and an output section 28. The input section 30 has an input end. The output section 28 has an output end. The output end of the output section 28 is located at the part of the sub-electrode 12C that is farthest from the cathode 4, as shown in FIG. 2. The input end of the input section 30 is located at the part of the sub-electrode 12C that is closest to the cathode 4, as shown in FIG. 2. The output end is separated from the sub-electrode 12B by the sub-electrode 12C and one gap 26, as shown in FIG. 2. However, the input end is separated from the sub-electrode 12B only by the one gap 26, as shown in FIG. 2.

It can be said that the fifth grid electrode 14 has an input section 32 and an output section 34, as shown in FIG. 2. The input section 32 has an input end. The output section 34 has an output end. The output end of the output section 34 is located at the part of the fifth grid electrode 13 that is farthest from the cathode 4, as shown in FIG. 2. The input end of the input section 32 is located at the part of the fifth grid electrode 14 that is closest to the cathode 4, as shown in FIG. 2.

A distance between the cathode 4 and the output end of the output section 28 of the fourth grid electrode 12 is greater than a distance between the cathode 4 and the output end of the output section 34 of the fifth grid electrode 14, as shown in FIG. 2.

As shown in FIG. 2, an electrostatic main focus lens ML2 is formed by a voltage difference between the focus voltage applied to the fourth grid electrode 12 and the anode voltage applied to the fifth grid electrode 14. The electrostatic main focus lens ML2 being formed just beyond the output end of the output section 28 of the fourth grid electrode 12, as shown in FIG. 2. Also, the electrostatic main focus lens ML2 can be said to be formed near to, adjacent to, or at the output end of the output section 28 of the fourth grid electrode 12, as shown in FIG. 2.

Figure 3:
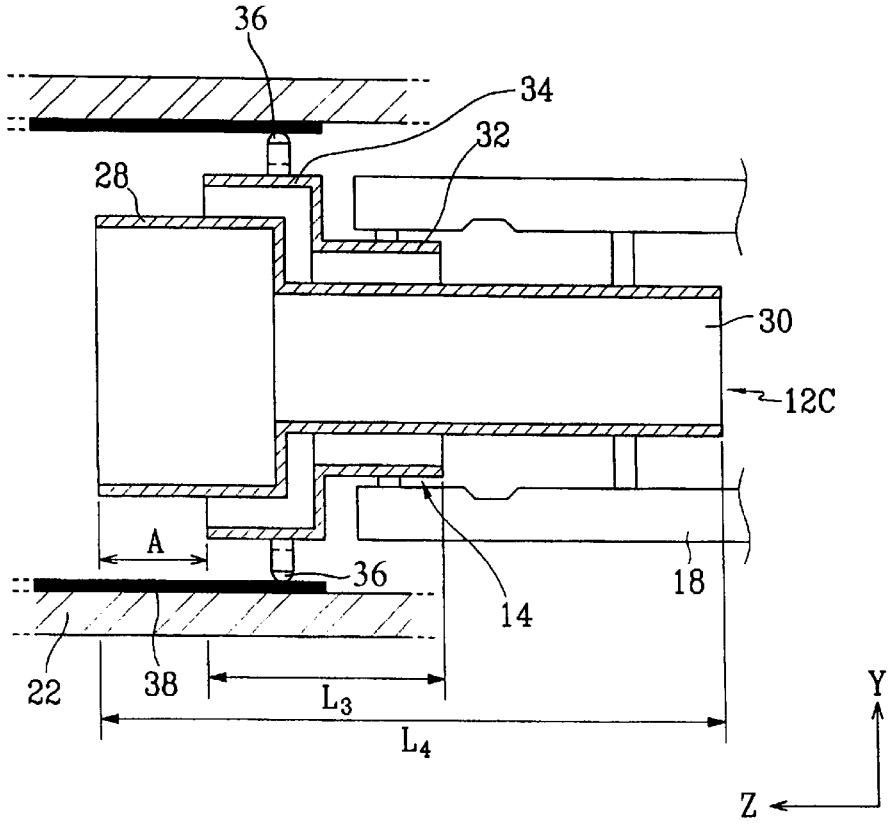
FIG. 3 is a partially enlarged view of a fourth grid electrode and a fifth grid electrode shown in FIG. 2, in accordance with the principles of the present invention.

FIG. 3 is a partially enlarged view of a fourth grid electrode and a fifth grid electrode shown in FIG. 2, in accordance with the principles of the present invention. FIG. 3 is a partially enlarged view of the third sub-electrode 12C and the fifth grid electrode 14. There is a distance of length A in the axis Z direction between the end of the output section 34 of the fifth grid electrode 14 and the end of the output section 28 of the third sub-electrode 12C. As a result, part of the output section 28 of the third sub-electrode 12C is exposed and is not surrounded by the fifth grid electrode 14 such that this exposed portion of the output section 28 of the third sub-electrode 12C opposes the graphite layer 38 deposited on the inner surface of the neck 22.

To realize this configuration, a length $L_3$ of the fifth grid electrode 14 in the axis Z direction is smaller than a length $L_4$ of the third sub-electrode 12C. Also, all of the fifth grid electrode 14 is positioned surrounding the third sub-electrode 12C in such a manner that the end of the output section 34 of the fifth grid electrode 14 is distanced from the end of the output section 28 of the third sub-electrode 12C by the length A as described above.

Figure 4:
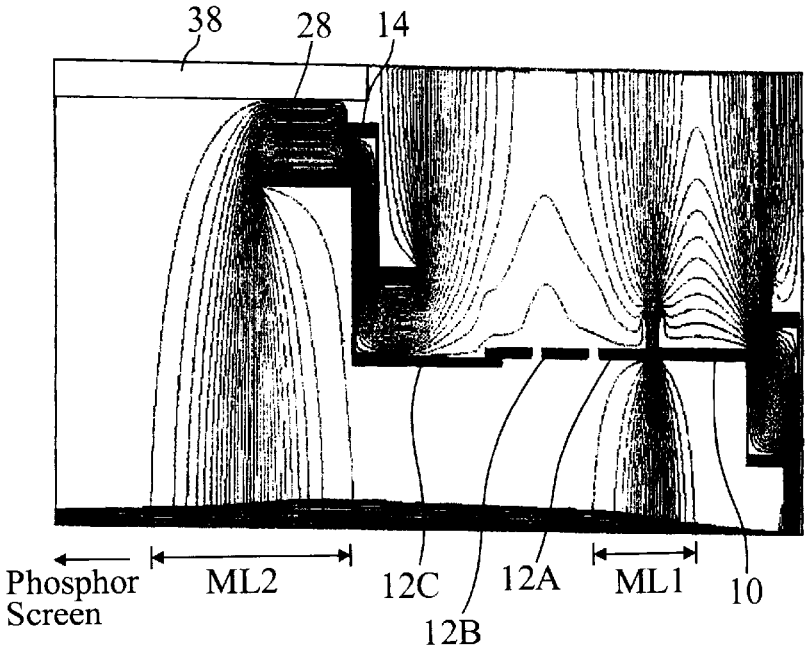
FIG. 4 is a schematic view showing equipotential lines and electron beam traces generated during driving of the electron gun of FIG. 1, in accordance with the principles of the present invention.
Figure 5:
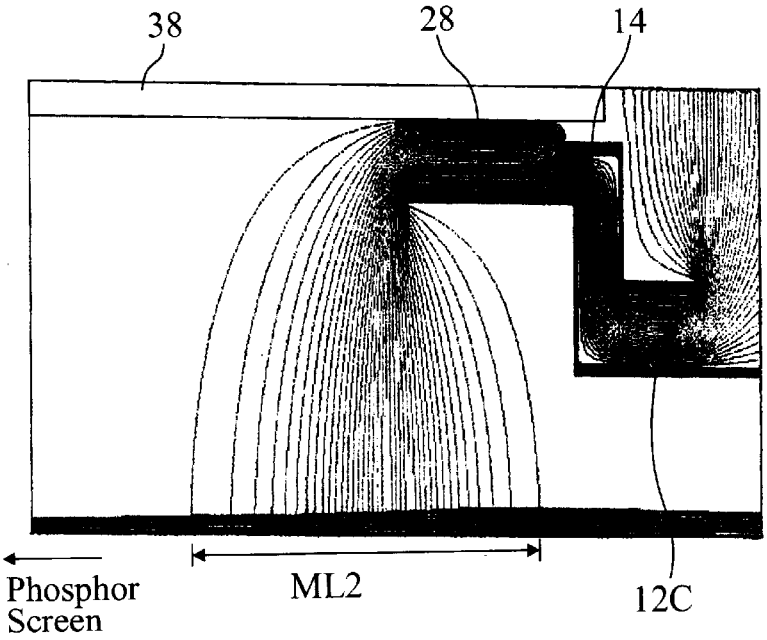
FIG. 5 is an enlarged view of FIG. 5, in accordance with the principles of the present invention.

FIG. 4 is a schematic view showing equipotential lines and electron beam traces generated during driving of the electron gun of FIG. 1, in accordance with the principles of the present invention. FIG. 5 is an enlarged view of FIG. 5, in accordance with the principles of the present invention.

It can be confirmed from the drawings that the second main focus lens ML2 is formed starting from the end of the output section 28 of the third sub-electrode 12C. The second main focus lens ML2 is formed by the difference between the focus voltage of the third sub-electrode 12C and the anode voltage of the graphite layer 38, and acts to converge the electron beam.

Accordingly, in the electron gun 2 according to the preferred embodiment of the present invention, the anode voltage applied to the graphite layer 38 and not the anode voltage of the fifth grid electrode 14 is used to form the second main focus lens ML2 by the potential difference with the fourth electrode 12. Therefore, a diameter of the second main focus lens ML2 is maximized within the limited diameter of the neck 22 to thereby improve electron beam focus performance.

The fifth grid electrode 14 and the graphite layer 38, to which a high anode voltage is applied, are designed so that an electrical short does not occur between these elements and the fourth grid electrode 12 to which the focus voltage is applied. That is, so that a short does not occur between these elements and the third sub-electrode 12C of the fourth grid electrode 12. The graphite layer 38 is an electrically conductive film.

Figure 6:
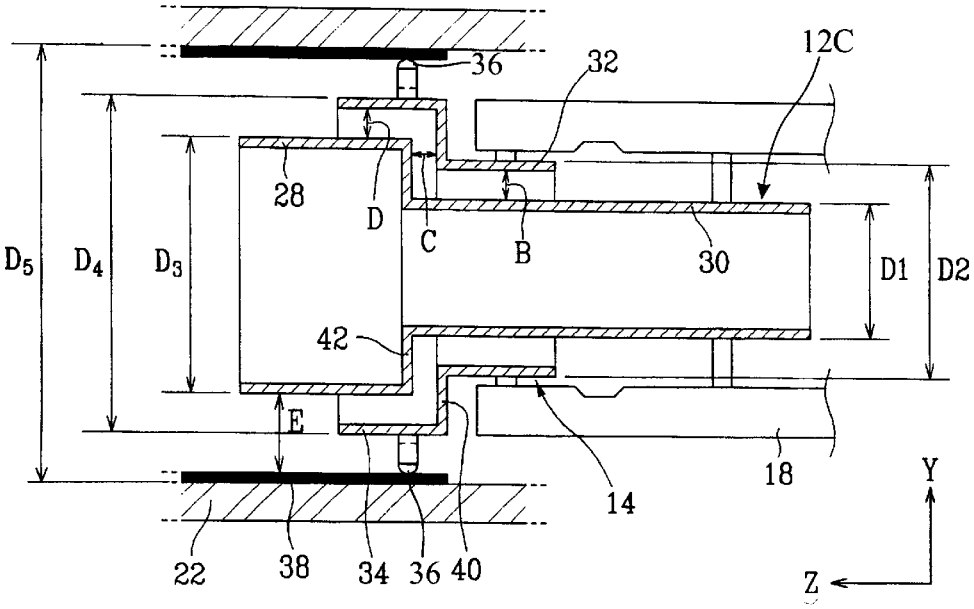
FIG. 6 is a partially enlarged view of a fourth grid electrode and a fifth grid electrode shown in FIG. 2, in accordance with the principles of the present invention.

FIG. 6 is a partially enlarged view of a fourth grid electrode and a fifth grid electrode shown in FIG. 2, in accordance with the principles of the present invention. In more detail, with reference to FIG. 6, an inner diameter of the input section 32 of the fifth grid electrode 14 is larger than an outer diameter of the third sub-electrode 12, and a distance of length B is formed therebetween. Further, a distance of length C is provided in the axis Z direction between a floor portion 40 interconnecting the output section 34 and the input section 32 of the fifth grid electrode 14 and a floor portion 42 interconnecting the output section 28 and the input section 30 of the third sub-electrode 12C. Also, an inner diameter of the fifth grid electrode 14 is larger than an outer diameter of the output section 28 of the third sub-electrode 12C, and a distance of length D is formed therebetween.

Preferably, the third sub-electrode 12C and the fifth grid electrode 14 are provided satisfying the conditions outlined below such that withstand voltage characteristics are maintained between the third sub-electrode 12C and the fifth grid electrode 14, and to allow for maximum inner and outer diameters of the output section 28 of the third sub-electrode 12C within the limited size of the neck 22.

$$1.08<D_2/D_1<2.0 \quad \text{[Equation 1]}$$

where $D_1$ is the outer diameter of the input section 30 of the third sub-electrode 12C, and $D_2$ is the outer diameter of the input section 32 of the fifth grid electrode 14. It is assumed that a thickness of the fifth grid electrode 14 does not exceed 500 micrometers ($\mu$m).

$$1.0<D_4/D_3<1.2 \quad \text{[Equation 2]}$$

where $D_3$ is the outer diameter of the output section 28 of the third sub-electrode 12C, and $D_4$ is the outer diameter of the output section 34 of the fifth grid electrode 14. It is assumed the thickness of the fifth grid electrode 14 does not exceed 500 micrometers ($\mu$m).

Further, it is preferable that the length C between the floor portion 40 interconnecting the output section 34 and the input section 32 of the fifth grid electrode 14 and the floor portion 42 interconnecting the output section 28 and the input section 30 of the third sub-electrode 12C is at least 2 millimeters (mm).

Also, there is provided a gap of length E between the output section 28 of the third sub-electrode 12C and the inner diameter of the neck 22. Preferably, the output section 28 of the third sub-electrode 12C satisfies the following condition with respect to the inner diameter of the neck 22 such that a maximum diameter is realized while maintaining withstand voltage characteristics of the graphite layer 38.

$$1.4<D_5/D_3<1.7 \quad \text{[Equation 3]}$$

where $D_3$ is the outer diameter of the output section 28 of the third sub-electrode 12C and $D_5$ is the inner diameter of the neck 22.

The fifth grid electrode 14 is spaced apart from the fourth grid electrode 12. The fifth grid electrode 14 is spaced apart from the fourth grid electrode 12 by at least a predetermined gap. As shown in FIG. 6, the gap between electrodes 14 and 12C includes at least three sections. As shown in FIG. 6, there is a first section of the between output section 28 of third sub-electrode 12C and the output secton 34 of fifth grid electrode 14, and that first section has a length D. As shown in FIG. 6, there is a second section of the gap between floor sections of third sub-electrode 12C and fifth grid electrode 14, and that second section has a length C. As shown in FIG. 6, there is a third section of the gap between input section 30 of third sub-electrode 12C and the input secton 32 of fifth grid electrode 14, and that third section has a length B.

Figure 7:
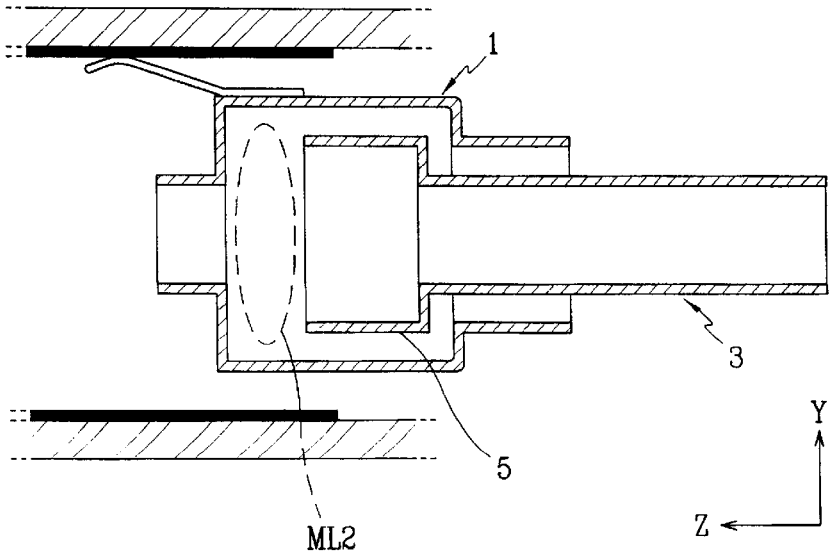
FIG. 7 is partially enlarged sectional views of a fourth grid electrode and a fifth grid electrode in an exemplary electron gun for cathode ray tubes.

FIG. 7 is partially enlarged sectional views of a fourth grid electrode and a fifth grid electrode in an exemplary electron gun for cathode ray tubes. Table 1 below shows various parameters including the equivalent diameter of the second main focus lens ML2 of the electron gun according to the preferred embodiment of the present invention and of an electron gun of a comparative example (see FIG. 7). In the electron gun of the comparative example, the structure between a cathode and a fourth grid electrode 3 is identical to that of the present invention.

Also, a fifth grid electrode 1 completely surrounds an output section 5 of the fourth grid electrode 3 such that the second main focus lens ML2 is formed within the fifth grid electrode 1. In Table 1 below, the output section of the fourth grid electrode 12 refers to the output section 28 of the third sub-electrode 12C of the fourth grid electrode 12.

TABLE 1

| | Neck outer diameter | Neck inner diameter | Outer diameter of fourth grid electrode outer diameter | Outer diameter of fifth grid electrode outer diameter | Equivalent diameter of ML2 (mm) |
|---|---|---|---|---|---|
| Comparative Example | 29.1 | 24.0 | 16.0 | 22 | 15.9 |
| Preferred Embodiment | 29.1 | 24.0 | 20.0 | 22 | 22.4 |

As shown in Table 1, in comparing the electron gun of the comparative example to the electron gun of the present invention, in which the output section 28 of the fourth grid electrode 12, that is, the output section 28 of the third sub-electrode 12C, is enlarged and exposed such that the equivalent diameter of the second main focus lens ML2 is improved for the present invention by approximately 40.8% over the comparative example.

Figure 8:
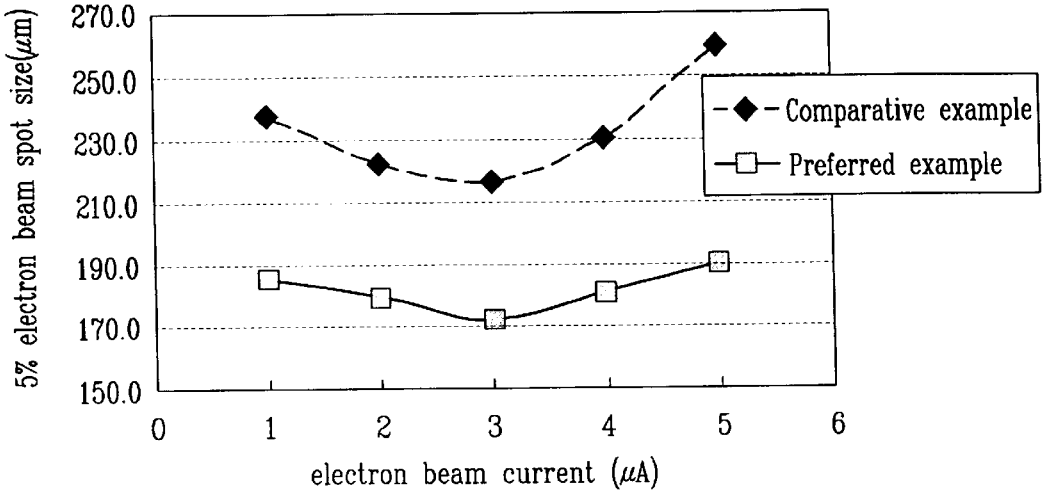
FIG. 8 is a graph showing 5% electron beam spot sizes according to variations in electron beam current for the electron gun of FIG. 1 and an exemplary electron gun.

FIG. 8 is a graph showing 5% electron beam spot sizes according to variations in electron beam current for the electron gun of FIG. 1 and an exemplary electron gun. Table 2 below and FIG. 8 show results of measuring 5% electron beam spot sizes according to variations in electron beam current for the electron gun of the present invention and the comparative example. Table 3 shown following Table 2 indicates the different voltages applied to each electrode while taking the measurements of Table 2 and FIG. 8.

TABLE 2

| Electron beam current microamps (μA) | | 1 | 2 | 3 | 4 | 5 |
|---|---|---|---|---|---|---|
| Electron beam spot size (μm) | Comparative Example | 238.26 | 223.26 | 216.88 | 230.91 | 260.00 |
| | Present Invention | 178.80 | 170.12 | 163.24 | 175.55 | 190.34 |
| Reduction (%) | | 22.1 | 19.6 | 20.6 | 21.7 | 26.6 |

TABLE 3

| | First grid electrode | Second grid electrode | Fourth grid electrode | Third and fifth grid electrodes |
|---|---|---|---|---|
| Comparative Example | 0 volts (V) | 350 V | 9.8 kV | 32 kV |
| Present Invention | 0 V | 350 V | 7.8 kV | 32 kV |

As shown in Table 2 and FIG. 8, the electron beam spot size of the electron beam spot size of the present invention is improved over that of the comparative example by about 20% or more in both low current and high current regions.

With the electron gun 2 according to the preferred embodiment of the present invention, in addition to the structure described above, it is also possible for the fourth grid electrode 12 or the fifth grid electrode 14 to be structured in a variety of ways such as in a tapered form.

Figure 9:
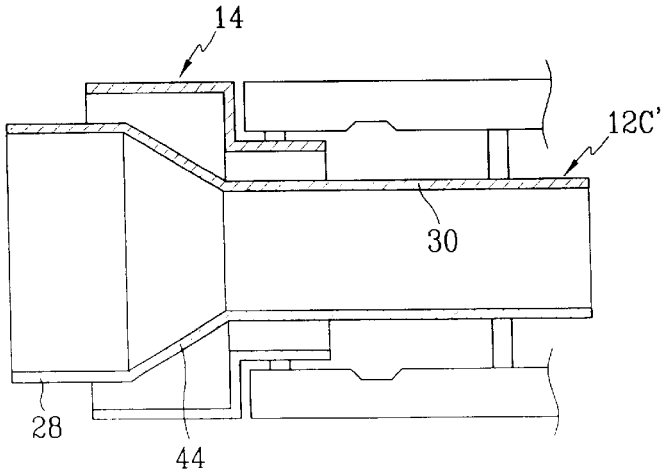
FIGS. 9 and 10 are partial sectional views of fourth and fifth grid electrodes according to other preferred embodiments of the present invention, in accordance with the principles of the present invention.
Figure 10:
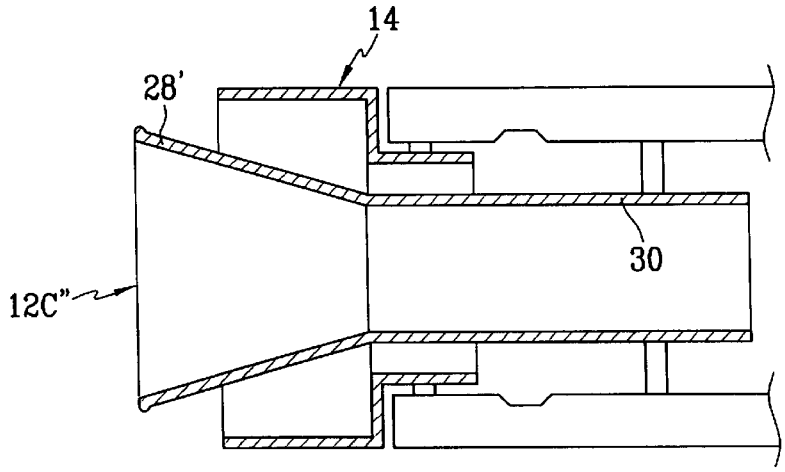

FIGS. 9 and 10 are partial sectional views of fourth and fifth grid electrodes according to other preferred embodiments of the present invention, in accordance with the principles of the present invention. With reference to FIG. 9, a third sub-electrode 12C' of a fourth grid electrode 12 has an angled section 44 of a predetermined length formed between an input section 30 and an output section 28. The angled section 44 interconnects the input section 30 and the output section 28. An end of the angled section 44 connected to the input section 30 has inner and outer diameters identical to the input section 30, then the angled section 44 has progressively enlarged inner and outer diameters until reaching the output section 28 where the angled section 44 has inner and outer diameters identical to the output section 28.

With reference to FIG. 9, the third sub-electrode 12C' of the fourth grid electrode 12 forms an angled section 44 between the input section 30 and the output section 28. As shown in FIG. 9, the angled section 44 has progressively larger diameters starting at a portion of the angled section 44 connected to the input section 30. Thus, a diameter of the angled section 44 at a location where the angled section 44 is connected to the output section 28 is larger than a diameter of the portion of the angled section 44 connected to the input section 30, as shown in FIG. 9.

With reference to FIG. 10, a third sub-electrode 12C" of a fourth grid electrode 12 is formed such that an output section 28' thereof is formed tapered, that is, progressively enlarged from its end connected to an input section 30 in a direction toward the phosphor screen.

With reference to FIG. 10, the third sub-electrode 12C" of the fourth grid electrode 12 forms an output section 28' that is angled. The angled output section 28' has a first end and has a plurality of different diameters and also has a second end, as shown in FIG. 10. The second end of the angled output section 28' is connected to the input section 30 of the fourth grid electrode 12, as shown in FIG. 10. The second end of the section 28' has a diameter substantially equal to a diameter of the input section 30 of the fourth grid electrode 12, as shown in FIG. 10. The first end has a diameter larger than the diameter of the second end, as shown in FIG. 10. As shown in FIG. 10, the second end of section 28' is disposed between the input section 30 and the first end of section 28'. Thus, using these terms, the first end of the section 28' is a first distance away from the cathode 4, the second end of the section 28' is a second distance away from the cathode 4, and the first distance is larger than the second distance, these distances of course being measured along a straight line. The first end of the section 28' is farther away from the cathode 4 than is the second end of the section 28'.

With the above configurations of adding the angled section 44 or tapering the output section 28' itself, the formation of an abrupt angle in the fourth grid electrode 12 is avoided to minimize the possibility of arc discharge occurring. This improves the withstanding voltage characteristics of the electron gun.

The fourth grid electrode 12 can alternatively be referred to as a "first electrode 12" of the electron gun 2. The fifth grid electrode 14 can alternatively be referred to as a "second electrode 14" of the electron gun 2. These alternative terms may be useful during detailed discussions of the grid electrodes 12 and 14, and during other times.

In the electron gun for cathode ray tubes of the present invention described above, the diameter of the main focus lens is maximized within the limited neck diameter. Therefore, the spot size of the electron beam landing on the phosphor screen is reduced by about 20% such that exceptional focus performance and resolution characteristics are realized.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit and scope of the applicant's general inventive concept.

What is claimed is:

1. An electron gun for a cathode ray tube, the electron gun comprising:

a cathode emitting electrons;

first and second grid electrodes forming a triode portion with said cathode;

a third grid electrode;

a fourth grid electrode receiving a focus voltage, said third grid electrode being disposed between said cathode and said fourth grid electrode, said fourth grid electrode including an input section and an output section, the input section being disposed between the output section and said third grid electrode;

a fifth grid electrode encircling a portion of said fourth grid electrode, at least a part of the output section of said fourth grid electrode being not encircled by said fifth grid electrode, said fifth grid electrode being spaced apart from said fourth grid electrode by a predetermined gap, said fifth grid electrode receiving an anode voltage; and a connector electrically connecting said third and fifth grid electrodes.

2. The electron gun of claim 1, said fourth grid electrode being cylindrical, a diameter of the input section being different than a diameter of the output section.

3. The electron gun of claim 1, said fourth grid electrode being cylindrical, a diameter of the output section of said fourth grid electrode being larger than a diameter of the input section of said fourth grid electrode.

4. The electron gun of claim 3, said fifth grid electrode being cylindrical and including an input section and an output section, the output section of said fifth grid electrode having a diameter larger than a diameter of the input section of said fifth grid electrode.

5. The electron gun of claim 4, said fourth and fifth grid electrodes satisfying the following condition:

$$1.08<D_2/D_1<2.0$$

where $D_1$ is an outer diameter of the input section of said fourth grid electrode, $D_2$ is an outer diameter of the input section of said fifth grid electrode, said fifth grid electrode having a thickness selected from among a first thickness of 500 micrometers and a second thickness of less than 500 micrometers.

6. The electron gun of claim 4, said fourth and fifth grid electrodes satisfying the following condition:

$$1.0<D_4/D_3<1.2$$

where $D_3$ is an outer diameter of the output section of said fourth grid electrode, $D_4$ is an outer diameter of the output section of said fifth grid electrode, said fifth grid electrode having a thickness selected from among a first thickness of 500 micrometers and a second thickness of less than 500 micrometers.

7. The electron gun of claim 3, the electron gun being mounted in a cathode ray tube, said fourth grid electrode satisfying the following condition:

$$1.4<D_5/D_3<1.7$$

where $D_3$ is an outer diameter of the output section of said fourth grid electrode, and $D_5$ is an inner diameter of a neck of the cathode ray tube.

8. The electron gun of claim 3, said fourth grid electrode forming an angled section between the input and output sections of said fourth grid electrode, the angled section having progressively larger diameters starting at a portion of the angled section connected to the input section of said fourth grid electrode, a diameter of the angled section at a location where the angled section is connected to the output section of said fourth grid electrode being larger than a diameter of the portion of the angled section connected to the input section of said fourth grid electrode.

9. The electron gun of claim 3, the output section of said fourth grid electrode including an angled section, the angled section having first end and a plurality of different diameters and a second end, the second end being connected to the input section of said fourth grid electrode, the second end having a diameter substantially equal to a diameter of the input section of said fourth grid electrode, the first end having a diameter larger than the diameter of the second end, the second end being disposed between the input section of said fourth grid electrode and the first end.

10. The electron gun of claim 1, said fourth grid electrode including at least two sub-electrodes separated by a gap.

11. An electron gun for a cathode ray tube, the electron gun comprising:

a single cathode emitting electrons;

first and second grid electrodes forming a triode portion with said cathode;

a third grid electrode;

a fourth grid electrode receiving a focus voltage, said third grid electrode being disposed between said cathode and said fourth grid electrode, said fourth grid electrode including an input section and an output section, the input section being disposed between the output section and said third grid electrode, the output section of said fourth grid electrode having an edge facing away from said cathode;

a fifth grid electrode receiving an anode voltage, said fifth grid electrode encircling a portion of said fourth grid electrode, at least a part of the output section of said fourth grid electrode being not encircled by said fifth grid electrode, said fifth grid electrode being spaced apart from said fourth grid electrode by a predetermined gap, said fifth grid electrode including an input section and an output section, the output section of said fifth grid electrode having an edge facing away from said cathode; and a connector electrically connecting said third and fifth grid electrodes, the edge of said fourth grid electrode being a first distance from said cathode, the edge of said fifth grid electrode being a second distance from said cathode, the first distance being larger than the second distance.

12. The electron gun of claim 11, said fourth grid electrode being cylindrical, a diameter of the input section being different than a diameter of the output section.

13. The electron gun of claim 12, a diameter of the output section of said fourth grid electrode being larger than a diameter of the input section of said fourth grid electrode.

14. The electron gun of claim 13, said fifth grid electrode being cylindrical, the output section of said fifth grid electrode having a diameter larger than a diameter of the input section of said fifth grid electrode.

15. The electron gun of claim 14, said fourth and fifth grid electrodes satisfying the following condition:

$$1.08<D_2/D_1<2.0$$

where $D_1$ is an outer diameter of the input section of said fourth grid electrode, $D_2$ is an outer diameter of the input section of said fifth grid electrode, said fifth grid electrode having a thickness selected from among a first thickness of 500 micrometers and a second thickness of less than 500 micrometers.

16. The electron gun of claim 13, the electron gun being mounted in a cathode ray tube, said fourth grid electrode satisfying the following condition:

$$1.4<D_5/D_3<1.7$$

where $D_3$ is an outer diameter of the output section of said fourth grid electrode, and $D_5$ is an inner diameter of a neck of the cathode ray tube.

17. The electron gun of claim 13, said fourth grid electrode forming an angled section between the input and output sections of said fourth grid electrode, the angled section having progressively larger diameters starting at a portion of the angled section connected to the input section of said fourth grid electrode, a diameter of the angled section at a location where the angled section is connected to the output section of said fourth grid electrode being larger than a diameter of the portion of the angled section connected to the input section of said fourth grid electrode.

18. The electron gun of claim 13, the output section of said fourth grid electrode including an angled section, the angled section having first end and a plurality of different diameters and a second end, the second end being connected to the input section of said fourth grid electrode, the second end having a diameter substantially equal to a diameter of the input section of said fourth grid electrode, the first end having a diameter larger than the diameter of the second end, the second end being disposed between the input section of said fourth grid electrode and the first end.

19. The electron gun of claim 14, said fourth and fifth grid electrodes satisfying the following condition:

$$1.0<D_4/D_3<1.2$$

where $D_3$ is an outer diameter of the output section of said fourth grid electrode, $D_4$ is an outer diameter of the output section of said fifth grid electrode, said fifth grid electrode having a thickness selected from among a first thickness of 500 micrometers and a second thickness of less than 500 micrometers.

20. The electron gun of claim 11, said fourth grid electrode including at least two sub-electrodes separated by a gap.

21. An electron gun for a cathode ray tube, the electron gun comprising:

a cathode emitting electrons;

a first electrode having an input section and an output section, an input end of the input section of said first electrode separating said cathode from an output end of the output section of said first electrode, said first electrode having a focus voltage applied; and a second electrode having an input section and an output section, an input end of the input section of said second electrode separating said cathode from an output end of the output section of said second electrode, said second electrode having an anode voltage applied, a distance between said cathode and the output end of the output section of said first electrode being greater than a distance between said cathode and the output end of the output section of said second electrode, said second electrode encircling a portion of said first electrode, at least a part of the output section of said first electrode being not encircled by said second electrode, said second electrode being spaced apart from said first electrode by a predetermined gap.

22. The electron gun of claim 21, the focus voltage applied to said first electrode having a voltage different from the anode voltage applied to said second electrode, the voltage difference between the focus voltage and the anode voltage forming a main focus lens at the output end of the output section of said first electrode.

23. The electron gun of claim 21, the focus voltage applied to said first electrode having a voltage different from the anode voltage applied to said second electrode, the electron gun being mounted in a cathode ray tube having an electrically conductive layer on an inner surface of a neck of the cathode ray tube, the layer being in electrical contact with said second electrode, the voltage difference between said first electrode and the layer forming a main focus lens at the output end of the output section of said first electrode.

24. The electron gun of claim 23, the layer extending from a portion of the neck located near the output end of the output section of said second electrode in a direction away from said cathode.

25. The electron gun of claim 21, said first electrode being cylindrical, a diameter of the input section being different than a diameter of the output section.

26. The electron gun of claim 21, said first electrode being cylindrical, a diameter of the output section of said first electrode being larger than a diameter of the input section of said first electrode, said first electrode including at least two sub-electrodes separated by a gap.

27. The electron gun of claim 26, said second electrode being cylindrical, the output section of said second electrode having a diameter larger than a diameter of the input section of said second electrode.

28. The electron gun of claim 27, said first and second electrodes satisfying the following condition:

$$1.08<D_2/D_1<2.0$$

where $D_1$ is an outer diameter of the input section of said first electrode, $D_2$ is an outer diameter of the input section of said second electrode, said second electrode having a thickness selected from among a first thickness of 500 micrometers and a second thickness of less than 500 micrometers.

29. The electron gun of claim 27, said first and second electrodes satisfying the following condition:

$$1.0<D_4/D_3<1.2$$

where $D_3$ is an outer diameter of the output section of said first electrode, $D_4$ is an outer diameter of the output section of said second electrode, said second electrode having a thickness selected from among a first thickness of 500 micrometers and a second thickness of less than 500 micrometers.

30. The electron gun of claim 26, the electron gun being mounted in a cathode ray tube, said first electrode satisfying the following condition:

$$1.4<D_5/D_3<1.7$$

where $D_3$ is an outer diameter of the output section of said first electrode, and $D_5$ is an inner diameter of a neck of the cathode ray tube.

31. The electron gun of claim 26, said first electrode forming an angled section between the input and output sections of said first electrode, the angled section having progressively larger diameters starting at a portion of the angled section connected to the input section of said first electrode, a diameter of the angled section at a location where the angled section is connected to the output section of said first electrode being larger than a diameter of the portion of the angled section connected to the input section of said first electrode.

32. The electron gun of claim 26, the output section of said first electrode including an angled section, the angled section having first end and a plurality of different diameters and a second end, the second end being connected to the input section of said first electrode, the second end having a diameter substantially equal to a diameter of the input section of said first electrode, the first end having a diameter larger than the diameter of the second end, the second end being disposed between the input section of said first electrode and the first end.

33. A method of operating an electron gun for a cathode ray tube, the method comprising:

emitting electrons from a cathode;

applying a focus voltage to a first electrode of the electron gun, the first electrode having an input section and an output section, an input end of the input section of the first electrode separating the cathode from an output end of the output section of the first electrode; and applying an anode voltage to a second electrode of the electron gun, the second electrode having an input section and an output section, an input end of the input section of the second electrode separating the cathode from an output end of the output section of the second electrode, a distance between the cathode and the output end of the output section of the first electrode being greater than a distance between the cathode and the output end of the output section of the second electrode, said second electrode encircling a portion of said first electrode, at least a part of the output section of said first electrode being not encircled by said second electrode, said second electrode being spaced apart from said first electrode by a predetermined gap.

34. The method of claim 33, the second electrode being electrically connected to a layer on an inner surface of a neck of a cathode ray tube receiving the electron gun, a voltage difference between the first electrode and the layer forming an electrostatic main focus lens.

35. The method of claim 33, said first and second electrodes being cylindrical, a diameter of the output section of said first electrode being larger than a diameter of the input section of said first electrode, the output section of said second electrode having a diameter larger than a diameter of the input section of said second electrode, said first electrode including at least two sub-electrodes separated by a gap.

36. The method of claim 35, said first and second electrodes satisfying the following condition:

$$1.08<D_2/D_1<2.0$$

where $D_1$ is an outer diameter of the input section of said first electrode, $D_2$ is an outer diameter of the input section of said second electrode.

37. The method of claim 36, said first and second electrodes satisfying the following condition:

$$1.0<D_4/D_3<1.2$$

where $D_3$ is an outer diameter of the output section of said first electrode, $D_4$ is an outer diameter of the output section of said second electrode.

38. The method of claim 37, said first electrode forming an angled section between the input and output sections of said first electrode, the angled section having progressively larger diameters starting at a portion of the angled section connected to the input section of said first electrode, a diameter of the angled section at a location where the angled section is connected to the output section of said first electrode being larger than a diameter of the portion of the angled section connected to the input section of said first electrode.

39. The method of claim 37, the output section of said first electrode including an angled section, the angled section having first end and a plurality of different diameters and a second end, the second end being connected to the input section of said first electrode, the second end having a diameter substantially equal to a diameter of the input section of said first electrode, the first end having a diameter larger than the diameter of the second end, the second end being disposed between the input section of said first electrode and the first end.

40. The method of claim 35, the electron gun being mounted in a cathode ray tube, said first electrode satisfying the following condition:

$$1.4<D_5/D_3<1.7$$

where $D_3$ is an outer diameter of the output section of said first electrode, and $D_5$ is an inner diameter of a neck of the cathode ray tube.

* * * * *